United States Patent [19]

Watson-Adams

[11] 4,378,256

[45] Mar. 29, 1983

[54] REDUCING GUN EROSION BY TRANSFER AND DIFFUSION COATING

[75] Inventor: Bertram R. Watson-Adams, Sevenoaks, England

[73] Assignee: The Secretary of State for Defence in Her Britannic Majesty's Government of the United Kingdom of Great Britain and Northern Ireland, London, England

[21] Appl. No.: 228,974

[22] Filed: Jan. 27, 1981

[30] Foreign Application Priority Data

Feb. 6, 1980 [GB] United Kingdom ..... 8003974

[51] Int. Cl.[3] ..... B05D 1/28; B05D 3/04; B05D 7/22; B05D 7/14

[52] U.S. Cl. ..... 148/6.15 R; 148/616; 148/62; 427/11; 427/55; 427/237

[58] Field of Search ..... 427/11, 55, 237; 148/6.15 R, 6.16, 6.2; 428/36, 458

[56] References Cited

U.S. PATENT DOCUMENTS 3,248,251 4/1966 Allen ..... 106/1.22 X

FOREIGN PATENT DOCUMENTS 437152 10/1935 United Kingdom .
542630 1/1942 United Kingdom .
574049 12/1945 United Kingdom .
704837 3/1954 United Kingdom .
850587 10/1960 United Kingdom .
887527 1/1962 United Kingdom .
950607 2/1964 United Kingdom .
950608 2/1964 United Kingdom .
995549 6/1965 United Kingdom .
1130875 10/1968 United Kingdom .
2014706 8/1979 United Kingdom .
2052693 1/1981 United Kingdom .

*Primary Examiner*—James R. Hoffman
*Attorney, Agent, or Firm*—Stevens, Davis, Miller & Mosher

[57] ABSTRACT

A method of reducing the erosion of surfaces of gun components on which there is flame impingement is provided. A thin coating containing metallic aluminium is applied to the surfaces, and is subsequently exposed to the hot compressed gases formed on firing. This causes diffusion of the aluminium into the surface, which reduces erosion. The coating may be applied either by the direct application of a paint containing metallic aluminium to the gun component then firing the gun, by applying such a paint to projectiles which are then fired from the gun, or by fitting a hollow frangible ring containing a composition which includes metallic aluminium around the body of the projectile, and then firing the projectile. The coating may advantageously contain aluminium silicide. A number of paints and compositions suitable for the invention are described.

11 Claims, 2 Drawing Figures

REDUCING GUN EROSION BY TRANSFER AND DIFFUSION COATING

This invention relates to methods of reducing the erosion of the surfaces of gun bores and breech blocks on which there is flame impingement. The internal surfaces of guns, eg the bore, and the face of the breech block and the primer vent if the gun uses a combustible cartridge case suffer erosion from a number of sources. The passage of the hot gases from combustion of the primer and the main propellant at a high velocity causes considerable erosion of the primer vent, internal face of the breech block and the gun bores. The primer vent is especially prone to flame erosion as hot gases from combustion of the main charge flash back down the primer vent. The passage of the projectile along the barrel, its driving band engaging with the rifling grooves causes further erosion of the bore, which is enhanced by the escape of gases around the trailing edge of the driving band.

The erosion results in the formation of pits in the bore and wearing away of accurately machined parts of the gun, such as the firing mechanism and rifling grooves. This is especially pronounced in areas which have been subjected to electrochemical corrosion resulting from deposition of pyrolysis products such as sulphides, nitrates, sulphates etc in small cracks in the gun from which they are not easily removed by cleaning. In addition, driving band debris builds up on the rifling grooves. This results in a consequential loss in performance of the gun. The reclamation of gun components is a difficult and costly process and it is therefore desirable to limit erosion as far as possible.

It has previously been known that the lifetime of iron and steel articles in environments where they are exposed to hot and corrosive gases such as for example in boilers, gas turbines and furnaces is increased by diffusing a small amount of aluminium into the surface of the metal by a suitable heat-treatment process such as pack diffusion. However such heat-treatment processes are expensive and difficult to apply to large components such as high calibre gun barrels and the bulk heating required would produce undesirable metallurgical and possibly dimensional changes.

According to the invention, a method of treating the surfaces of gun components which are exposed to erosive environments comprises applying to the surface of said components a coating containing aluminium metal and subsequently exposing said components to the hot compressed gases formed on firing the gun to diffuse the aluminium into the surface. The invention therefore provides a method for enhancing the resistance of the internal surfaces of a gun bore to high temperature flame impingement which does not require any complex extraneous heat-treatment processes to be applied to large components. In addition the invention enables the protective infusion of particulate aluminium to be applied locally by the heating caused to the inside of the gun by the high temperature of the gases generated on firing, without imparting large quantities of heat energy likely to cause distortion of the gun or loss of mechanical strength as may occur if an entire component were subjected to a heat-treatment process. The combustion gases also produce a nitrogenous atmosphere which in the presence of aluminium induces diffusion of both aluminium and nitrogen and as a result confers beneficial compressive stresses into the gun bore.

A further advantage of the invention is that the diffusion of aluminium into the surface of the gun barrel is found to substantially reduce the deposition of driving band debris from iron driving bands in the gun barrel.

This invention is applicable to a wide range of steel barrelled guns, but is not likely to be suitable for use with projectiles fitted with copper driving bands, as cuprous oxide, which is formed at temperatures as low as 350° C. and deposited along the barrel may impair diffusion of particulate aluminium into the gun bore. The coating containing aluminium metal may be applied to the surface of the gun component by a number of methods, depending on the nature of the component.

According to one embodiment of the invention, the internal faces of breech blocks, primer vents and the rear part of the barrel forming the powder chamber may be coated with a coating containing powdered metallic aluminium or a mixture of aluminium powder and powdered aluminium silicide. Firing of the gun causes the aluminium to diffuse into the metal surface. A number of applications of the coating followed by firing of the gun may be necessary to build up a suitable quantity of diffused aluminium to protect adequately against erosion. Protection of these parts of the gun will generally only be necessary in guns which use consumable or combustible cartridge cases, as a metal cartridge case will normally protect the rear of the barrel from contact with hot erosive gases, and only the portions of the bore in front of the cartridge case will need protection. Application of an aluminium containing coating to the forward parts of a gun bore along which the projectile travels will not generally be satisfactory, as any slight bending of the barrel prior to firing may cause cracking of the coating film and loss of coating uniformity. In addition, the presence of this relatively large amount of aluminium powder on the inside of the barrel may result in pyrophoricity, leading to excessively high pressures inside the barrel and a consequent loss in performance. Damage to the barrel may even result. According to an alternative embodiment of the invention, therefore the coating may be applied to the surface of the projectiles, and may be conveniently applied instead of an anti rust or beneath an identification paint without the need of an etch primer. Advantageously this application of an aluminium-containing coating to projectiles enables an aluminium-containing surface layer to be built up on the inside of the barrel and continuously maintained during the normal use of the gun. Firing such a coated projectile will leave a thin smear of aluminium on the internal surface of the gun bore, which is then caused to diffuse into the steel surface by the hot gases following the projectile. Suitable coatings should preferably not contain any organic solvents, hardeners, emulsifiers, etc to reduce the likelihood of formation of carbonaceous deposits which might otherwise hinder diffusion of the aluminium or increase corrosion in the gun.

Preferably the aluminium-containing coating should only be applied to areas of the shell forward of the driving band, to avoid pyrophoricity as the aluminium comes into contact with the hot gases generated on combustion of the propellant charge. The rear of the shell may be coated with a thermally stable coating such as a dry lubricant if desired, for example a PTFE-containing coating as described in U.K. Pat. No. 1,019,202.

A preferred coating, suitable for application either to breech blocks, etc. or to projectiles, contains entirely inorganic materials, and is capable of being cured at an elevated temperature after drying so as to form strong ceramic-type bonds in its structure which cause the cured coating to be water-insoluble and to adhere strongly to the metal surface of a gun barrel or shell and not be easily dislodged during rough handling under service conditions. Coatings of this type are described in U.K. Pat. Nos. 1,015,425; 1,030,285 (a Patent of Addition to No. 1,015,425) and U.S. Pat. No. 3,248,251. The coatings described in these patents contain, in addition to aluminium particles and an inorganic carrier liquid, additives which prepare the metal surface and promote efficient wetting, such as inorganic chromates, dichromates, molybdates or mixtures thereof, additives which assist bonding of the coating to the surface, such as phosphoric acids (preferably orthophosphoric but alternatively meta, pyro or hypo phosphoric), and additives such as magnesium oxide, aluminium hydroxide and zinc hydroxide, which control the rate of the curing process and cause formation of a strong ceramic structure. The addition of aluminium silicide particles as described in U.S. Pat. No. 3,248,251 is found to be beneficial. Inorganic pigments may also be added to provide colour. It is to be noted that the composition above contains free phosphoric and chromic acid, and hence it is advisable to prepare a mixture of all the ingredients except aluminium, and add the aluminium powder immediately prior to use. Such coatings may be applied by entirely conventional methods for example spraying, brushing or preferably electrophoretically, following preparation of the metal surface for example by light gritting. It is only necessary to apply an extremely thin layer of the aluminium-containing coating, as thick layers may result in undesirable pyrophoricity. For this reason the coating should preferably not be applied by dipping as gravity effects may leave a thick coat. The coating may be air-dried at ambient temperature and then dried at an elevated temperature of generally about 120° to 550° C., depending on the composition used, so as to give a hard chemically-bonded coating. The length of time necessary to achieve cure will depend on the temperatures.

Advantageously, an extremely fast cure may be achieved if radiant heating at an even higher temperature is used, such radiant heating only affecting the surface of a painted substrate, and therefore eliminating the need to heat the entire bulk of a large article such as a breech block. Coatings containing chromates should preferably be cured at a temperature above 350° C in order to reduce the metal surface and inhibit oxidation of the aluminium.

According to another embodiment of the invention, which is again suitable for coating the forward parts of a gun bore, a hollow ring, made of some frangible or easily rupturable material and containing a composition which includes powdered aluminium metal is fitted around the body of a projectile, preferably just forward of the driving band. On firing a projectile so fitted, the ring disintegrates and the aluminium-containing composition is smeared over the walls of the gun bore and is caused to diffuse into the surface of the gun bore by the hot compressed gases following the projectile.

The ring is preferably made of some flexible and slightly elastic material to enable it to be easily fitted over the body of the projectile and to grip tightly around the body. It may conveniently be made of a plastics material such as Nylon 66. The wall thickness of the ring should be as thin as possible to avoid deposition of excessive amounts of carbonoceous matter in the gun barrel.

The aluminium-containing composition contained in the hollow ring is most conveniently in the form of a viscous paste of aluminium powder and other materials for example to stabilise the paste or to achieve a suitable viscosity. Organic materials should preferably not be included in the aluminium-containing composition to avoid deposition of carbonaceous matter in the gun barrel. Suitable compositions include the commercially available moulding compositions described in U.K. Pat. No. 1,030,385 which contain 50 to 98% by weight of aluminium powder of grain size 325-200 mesh (Tyler). The remainder comprising water, chromates and phosphates.

This embodiment of the invention is most conveniently used with projectiles of high calibre, ie above 30 mm. The quantity of aluminium necessary for achieving suitable protection of a gun barrel will depend on the calibre of the weapon, but in general a suitable quantity, using a composition as described above, would be contained in a ring with a body of circular cross section with an internal diameter of 2–4 mm. Quantities of aluminium in excess of this should be avoided as they may result in pyrophoricity, causing overpressures in the barrel.

The invention will now be described by way of example only with reference to the accompanying drawings in which.

EXAMPLE 1

An inorganic coating having the composition below:

$MgCro_4.7H_2O$: 266 g
$H_3PO_4$: 98 g
$Mg(H_2PO_4)_2.3H_2O$: 372 g
$H_2O$ to 1000 cc
Aluminium Powder (Spherical 5–10 micron diam): 600 g as described in U.K. Pat. No. 1,030,285 was applied to medium calibre steel shell cases with sintered iron driving bands by spraying so as to form a coating approximately 0.0005 inches thick. The coating was then air dried, and cured by heating for 15 to 50 minutes at 375° C., followed by 5 to 10 minutes at 550° C. to give a tough coating. Shells prepared using these cases were then used under normal service conditions and were found to cause transfer of aluminium onto the surface of the gun bore.

EXAMPLE 2

The walls of the primer vent of a large calibre gun were coated with a layer of a coating as described in example 1 above, to a thickness of 0.02 inches by a process of electrophoretic deposition. The coating was then air dried and cured as above. On firing the gun in normal service, aluminium was caused to diffuse into the walls of the primer vent, and a substantial reduction of erosion of the vent by hot gases on subsequent firings of the gun was experienced.

EXAMPLE 3

Figure 1:
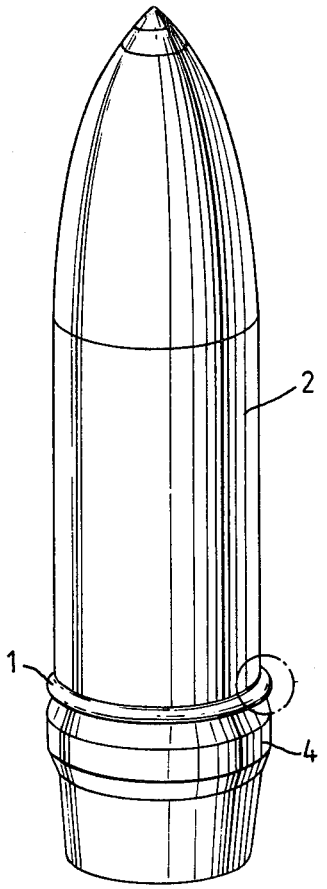
FIG. 1 shows a perspective view of a large calibre shell fitted with a hollow ring containing an aluminium-containing composition.
Figure 2:
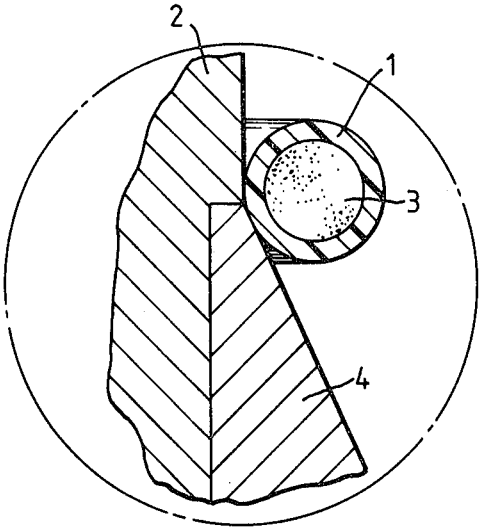
FIG. 2 shows a section through the shell wall, driving band and the ring in the area ringed in FIG. 1.

With reference to FIGS. 1 and 2 a hollow ring 1, suitable for use on a high-calibre shell 2 was prepared by taking a length of Nylon 66 tubing of internal diameter 4 mm and of length equal to the circumference of the shell 2. This length of tubing was then filled, except for a few mm at each end, with an aluminium-containing paste 3 as described in U.K. Pat. No. 1,030,385 which contained 80% by weight of aluminium powder (grain size 325–200 mesh) and 20% by weight of an aqueous liquid with the composition:

$H_3PO_4$: 196 g
MgO: 50 g
$Mg(H_2PO_4)_2.6H_2O$: 50 g
$MgCr_2O_7.6H_2O$: 170 g
Water: to 1000 cc The ends of the length of tubing were then joined by heat welding so as to form a sealed ring. The ring 1 was then fitted around the shell 2 immediately in front of the driving band 4 so that on firing the shell and ring in normal service the ring would be ruptured by the rifling causing the paste to be deposited on the interior surface of the gun bore and hence aluminium to diffuse into the surface of the gun bore.

I claim:

1. A method of treating the steel surfaces of gun components which are exposed to erosive environments comprising
   (a) applying to the surface of said components a coating material containing metallic aluminium, said coating material being first applied in a liquid vehicle and subsequently dried, and
   (b) exposing said components to the hot compressed gases formed on firing said gun to cause the aluminium to diffuse into the surface of the gun components.

2. A method according to claim 1, wherein said liquid vehicle contains additives selected from the group consisting of additives which prepare the surface and promote wetting, additives which assist bonding of said coating material to the surface, and additives which form ceramic-type bonds on heat curing.

3. A method according to claim 2, wherein said additives to assist bonding to the surface are selected from the group consisting of phosphoric acids.

4. A method according to claim 2, wherein said additives to prepare the surface and promote wetting are selected from the group consisting of chromates, dichromates and molybdates.

5. A method according to claim 2, wherein said additives to form ceramic-type bonds are selected from the group consisting of magnesium oxide, aluminium oxide, zinc hydroxide and mixtures therof.

6. A method according to claim 1, wherein said coating material is cured at an elevated temperature after coating.

7. A method according to claim 1 wherein said curing is carried out using radiant heat.

8. A method according to claim 1 wherein said coating material consists entirely of inorganic materials.

9. A method of treating the steel surfaces of gun components which are exposed to erosive environments comprising
   (a) fitting, around the body of a projectile, a hollow ring of frangible or easily rupturable material, said ring containing a composition which comprises a viscous paste containing metallic aluminium and a liquid vehicle, and
   (b) firing the projectile from the gun so that the ring disintegrates, the gun components are coated with the composition, the coated components are exposed to the hot compressed gases formed on firing the gun and the aluminium diffuses into the surface of the gun components.

10. A method for reducing erosion of the steel surfaces of gun components which are exposed to hot corrosive gases when a cartridge is fired in a gun, said method comprising
   (a) applying to the surface of the components, in a liquid vehicle, a coating material containing aluminium,
   (b) drying the coating material, and
   (c) firing a cartridge in the gun whilst the aluminium remains on the surface, so that the aluminium is caused to diffuse into the surface by exposure of the coated surface to the hot compressed gases produced by firing the cartridge.

11. A method of treating the steel surfaces of gun components which are exposed to erosive environments comprising
   (a) applying to the surface of a projectile, in a liquid vehicle, a coating material containing metallic aluminium,
   (b) drying the coating material, and
   (c) firing the projectile from the gun so that a proportion of the coating material is transferred to the surface of the components, the coated components are exposed to the hot compressed gases formed on firing the gun and the aluminium diffuse into the surface of the gun components.

* * * * *